US009763528B2

(12) United States Patent
Lung et al.

(10) Patent No.: US 9,763,528 B2
(45) Date of Patent: Sep. 19, 2017

(54) TRACK FOR SLOTTED WALL SYSTEM

(71) Applicants: Lau Man Lung, Shenzhen (CN); Michael J. Scherzer, Benton Harbor, MI (US)

(72) Inventors: Lau Man Lung, Yuen Long (CN); Michael J. Scherzer, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/431,526

(22) PCT Filed: Sep. 27, 2012

(86) PCT No.: PCT/CN2012/082229

§ 371 (c)(1),
(2) Date: Mar. 26, 2015

(87) PCT Pub. No.: WO2014/047857

PCT Pub. Date: Apr. 3, 2014

(65) Prior Publication Data

US 2015/0250334 A1 Sep. 10, 2015

(51) Int. Cl.
*A47F 5/08* (2006.01)

(52) U.S. Cl.
CPC ..... *A47F 5/0853* (2013.01); *A47F 5/0846* (2013.01)

(58) Field of Classification Search
CPC ..... A47F 5/0846; A47F 5/08; A47F 5/0853; A47B 96/067; A47B 95/008
USPC ..... 211/87.01, 94.01
See application file for complete search history.

(56) References Cited

U.S. PATENT DOCUMENTS 4,607,753 A * 8/1986 Radek ..... A47F 5/0846 211/189
4,618,192 A * 10/1986 Kelley ..... A47F 5/0846 108/152
4,629,076 A * 12/1986 Amstutz ..... A47F 5/0846 156/64
4,747,025 A * 5/1988 Barton ..... A47F 5/0846 211/94.01
4,944,416 A * 7/1990 Petersen ..... A47F 5/0846 211/87.01
5,138,803 A * 8/1992 Grossen ..... A47F 5/0846 211/103
5,185,971 A * 2/1993 Johnson, Jr. ..... A47B 57/408 211/94.01
5,390,462 A * 2/1995 Kreiter ..... A47F 5/0846 211/189

(Continued)

FOREIGN PATENT DOCUMENTS

CN 2448885 Y 9/2001
CN 201675519 U 12/2010

OTHER PUBLICATIONS

International Search Report and Written Opinion for Counterpart PCT/CN2012/082229, dated Mar. 21, 2013.

*Primary Examiner* — Patrick Hawn

(57) ABSTRACT

A track (12) for a slotted wall system forms a slot (26) configured to receive a portion of a bracket and support the bracket and load carried by the bracket to define one or more load-bearing locations (A,B) on the track (12). The track (12) is formed of a base material coextruded with a reinforcing material selectively positioned at one or more load-bearing locations (A,B) on the track (12).

14 Claims, 8 Drawing Sheets

(56) References Cited

U.S. PATENT DOCUMENTS

| | | | | |
|---|---|---|---|---|
| 5,899,344 | A * | 5/1999 | Current | A47F 5/0846 211/94.01 |
| 6,363,645 | B1 * | 4/2002 | Hunter | A47F 5/0846 211/87.01 |
| 6,491,172 | B2 * | 12/2002 | Chance | A47F 5/0846 211/87.01 |
| 6,772,890 | B2 * | 8/2004 | Campbell | A47F 5/0846 211/189 |
| 2010/0000953 | A1 * | 1/2010 | Shew | H05K 7/1401 211/183 |

* cited by examiner

TRACK FOR SLOTTED WALL SYSTEM

CROSS-REFERENCE TO RELATED APPLICATIONS

This application claims priority on International Application No. PCT/CN2012/082229, filed Sep. 27, 2012, the disclosure of which is incorporated herein in its entirety.

BACKGROUND

Slotted wall systems are typically used for hanging or otherwise storing items on a vertical wall and often include a panel mounted to the wall and having tracks that form slots configured to adjustably receive brackets. A variety of supports, such as hooks, shelves, baskets, caddies, bins, and racks, may be coupled to the bracket for supporting the items.

SUMMARY

A panel according to one embodiment of the invention for a slotted wall system including one or more brackets configured to mount a load to the panel may comprise a track forming a slot configured to receive a portion of a bracket and support the bracket and load carried by the bracket to define one or more load-bearing locations on the track. The panel may be formed of a base material coextruded with a reinforcing material selectively positioned at at least one of the one or more load-bearing locations on the track.

DESCRIPTION OF EMBODIMENTS OF THE INVENTION

Figure 1A:
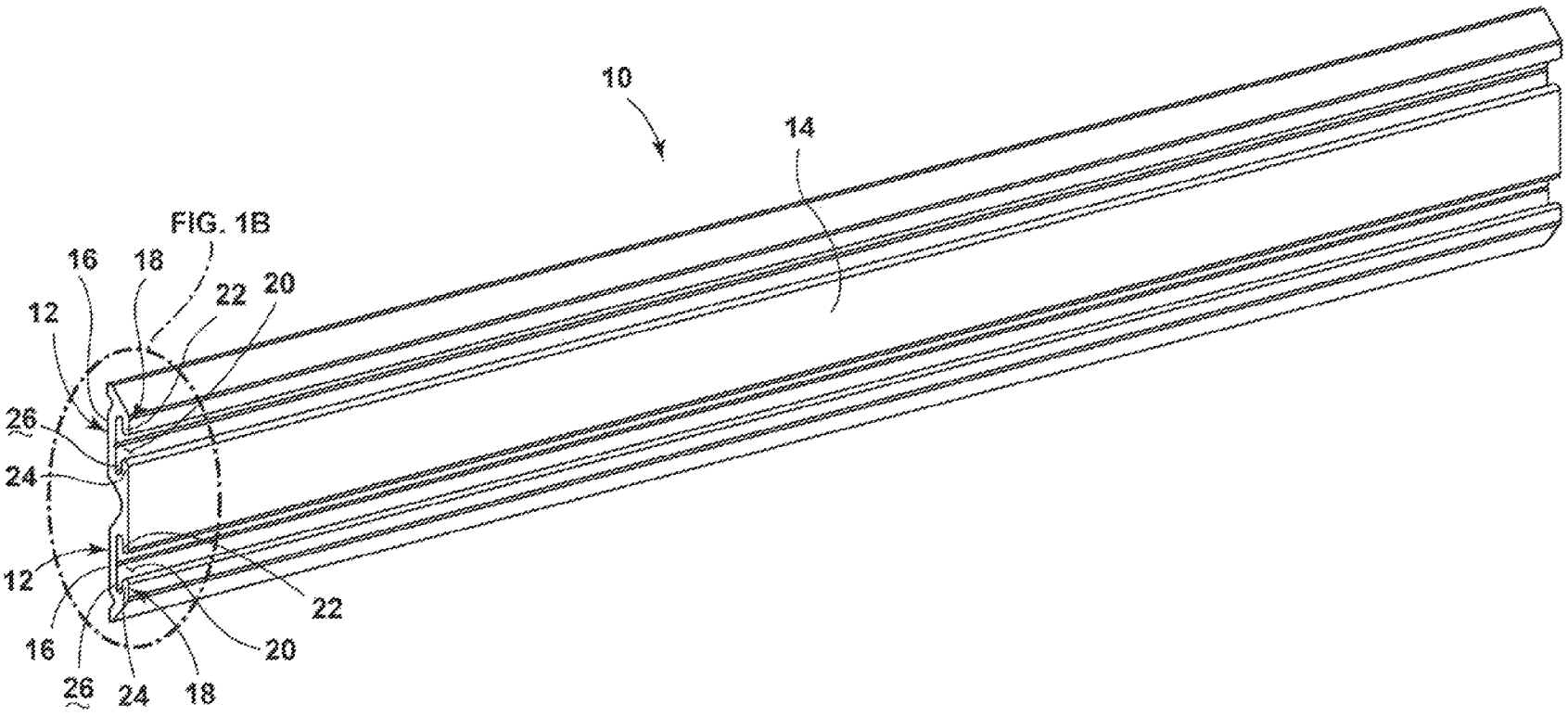
FIG. 1A is perspective view of a panel having a track according to one embodiment of the invention.
Figure 1B:
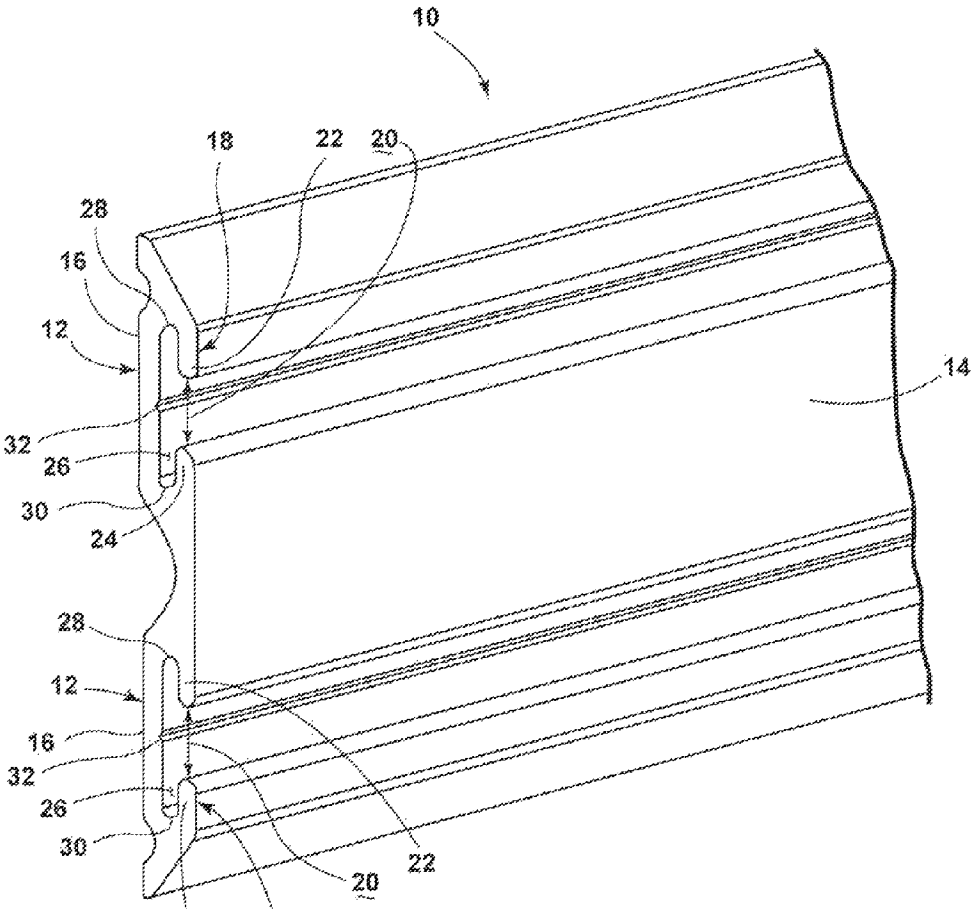
FIG. 1B is an enlarged view of an end of the track from FIG. 1A.

FIG. 1A illustrates a panel 10 according to one embodiment of the invention for use in a slotted wall system. The illustrated panel 10 includes two tracks 12 oriented generally parallel to one another and together forming an elongated slat 14 between the tracks 12. The particular configuration of the track 12 is not germane to the invention, and the tracks 12 shown in the figures and described below are provided for illustrative purposes only. Each of the exemplary tracks 12 has a rear wall 16 spaced from a front wall 18 having an opening 20. The opening 20 divides the front wall 18 into an upper front wall 22 and a lower front wall 24. As viewable from the end of the panel 10 enlarged in FIG. 1B, the track 12 has a generally C-shaped cross-sectional configuration. The opening 20 is part of and provides access to a generally T-shaped slot 26 having an upper channel 28 defined between the upper portion of the rear wall 16 and the upper front wall 22 and a lower channel 30 defined between the lower portion of the rear wall 16 and the lower front wall 24. Further, the track 12 may include a groove 32 located on the rear wall 16 facing the slot 26. The groove 32 may be positioned about halfway between the upper and lower channels 28, 30, as illustrated, or at any other suitable position. When installing the panel 10 onto a wall, hardware, such as screws, nails, and the like, may be inserted through the panel 10 at the groove 32 and into the wall.

The panel 10 may be mounted to any type of wall or generally vertical surface, including a door, and mounted at any suitable location on the wall. The hardware may optionally be inserted into a stud on the wall, such as a wood stud, or into locations other than locations having a stud. As used herein, the term "wall" refers to any structure to which the panel 10 may be mounted. Further, any type of hardware may be employed to mount the panel 10 to the wall, including hardware coupled to the side of the panel 10 facing the wall or to the top, bottom, and side edges of the panel 10 rather than being inserted through the panel 10.

Figure 2:
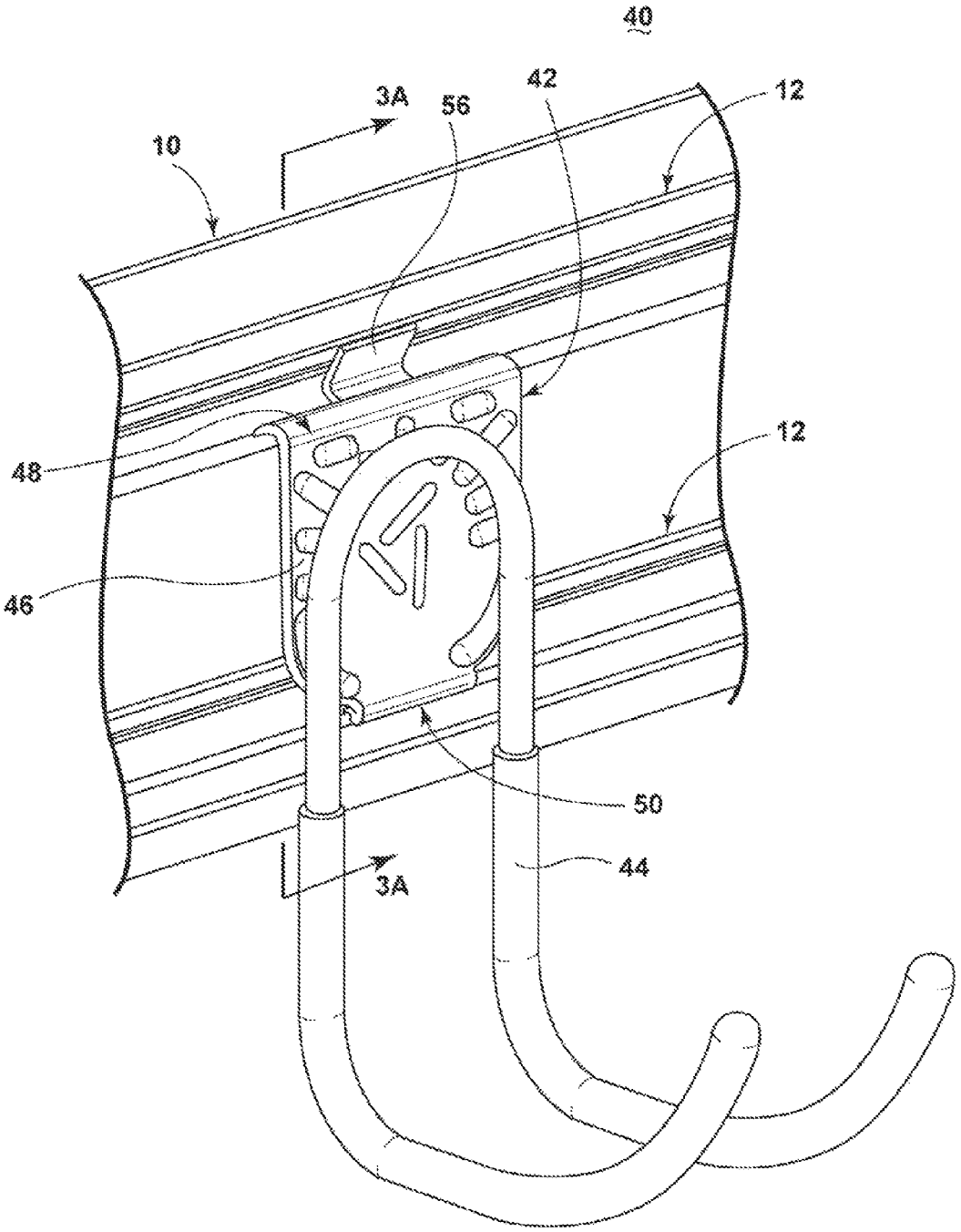
FIG. 2 is a perspective view of a slotted wall system according to an embodiment of the invention having the panel from FIG. 1A and an exemplary bracket mounted to the track on the panel.
Figure 3A:
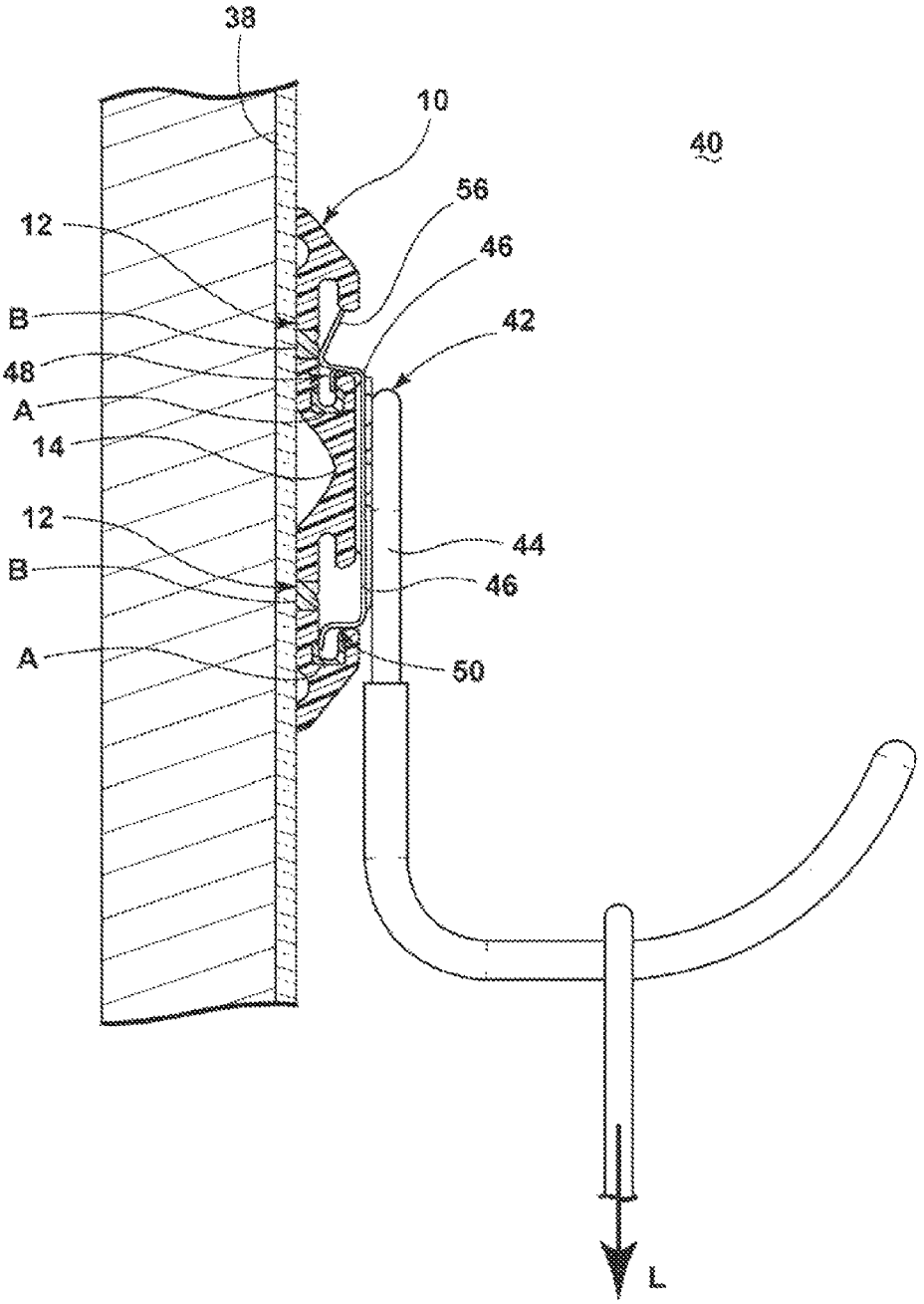
FIG. 3A is a sectional view of the slotted wall system of FIG. 2 taken along line 3A-3A.
Figure 3B:
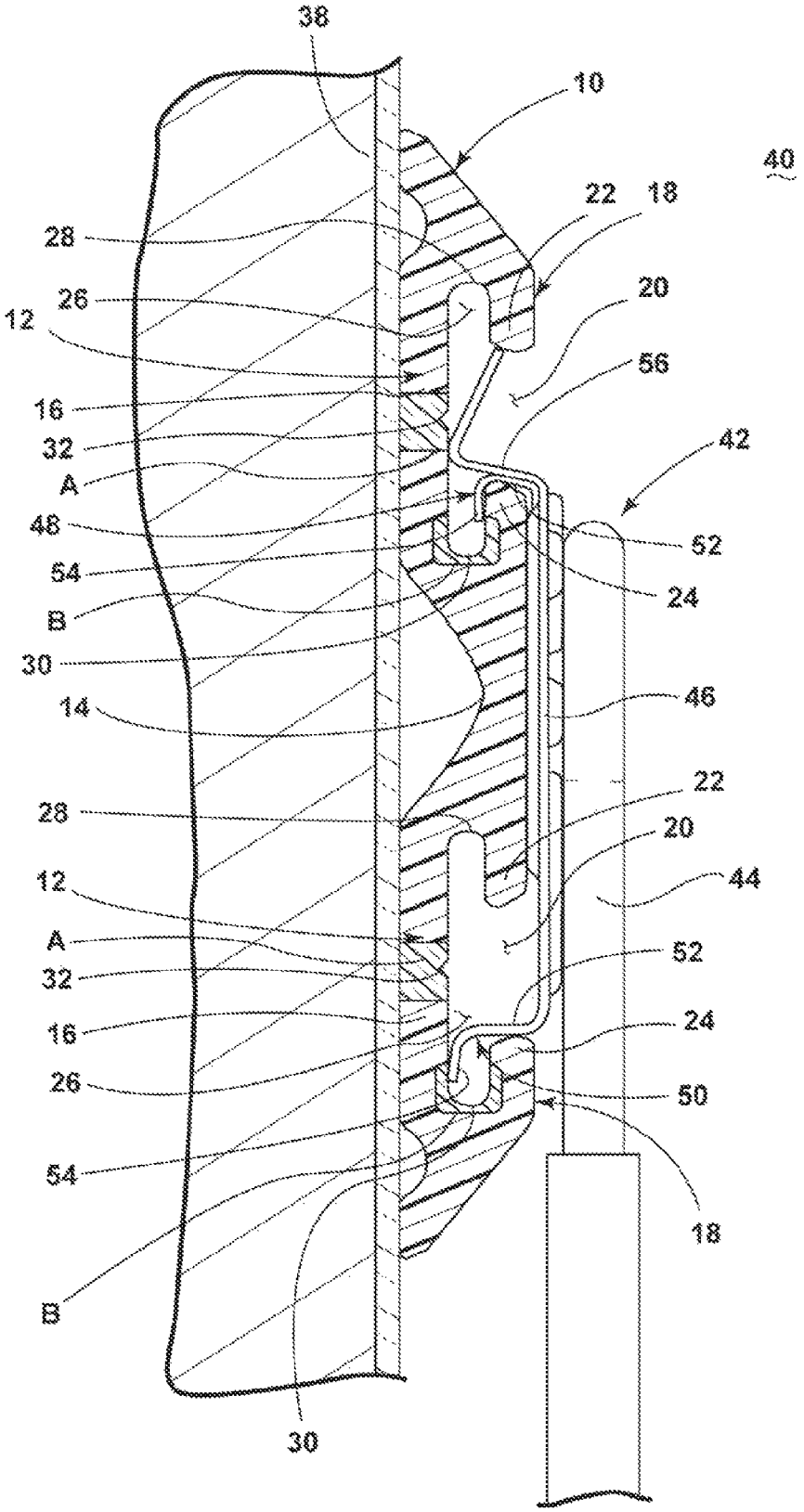
FIG. 3B is an enlarged view of the track and bracket from FIG. 3A.

Referring now to FIG. 2, a slotted wall system 40 according to an embodiment of the invention may include the panel 10 and a bracket 42 adjustably and removably mounted to the adjacent tracks 12 on the panel 10 coupled to a support 44 in the form of a hook. The support 44 may be any desired type of support, including hooks, shelves, baskets, caddies, bins, and racks, for hanging or otherwise supporting an item on the slotted wall system 40. The type of the support 44 is not germane to the invention. The exemplary illustrated bracket 42 includes a body 46, which may be a generally planar structure, with a plurality of projections that facilitate mounting the bracket 42 to the track 12. As shown in FIG. 3A, which is a sectional view taken along line 3A-3A of FIG. 2 with the panel 10 mounted to a wall 38, and FIG. 3B, which is an enlarged view of the track portion of FIG. 3A, an upper projection 48 and a lower projection 50, each having a first portion 52 extending generally perpendicular to the body 46 and a second portion 54 extending downward from the first portion 52 generally parallel to the body 46, project from the upper and lower edges, respectively, of the body 46 to engage the lower front walls 24 of the adjacent tracks 12. The upper and lower projections 48, 50 may differ, as illustrated with the first portion 52 of the upper projection 48 being shorter than that of the lower projection 50 and the second portion 54 of the upper projection 48 being longer than that of the lower projection 50, or the upper and projections 48, 50 may be the same. Further, another projection in the form of a tab 56 may be disposed on the upper edge of the body 46 and may be formed with or separate from the upper projection 48 for engaging the rear wall 16 and the upper front wall 22 of the track 12. It is to be understood that the particular bracket 42 and configurations of the projections 48, 50, 56 are not germane to the invention and that any suitable bracket may be employed with the slotted wall system 40.

Figure 4:
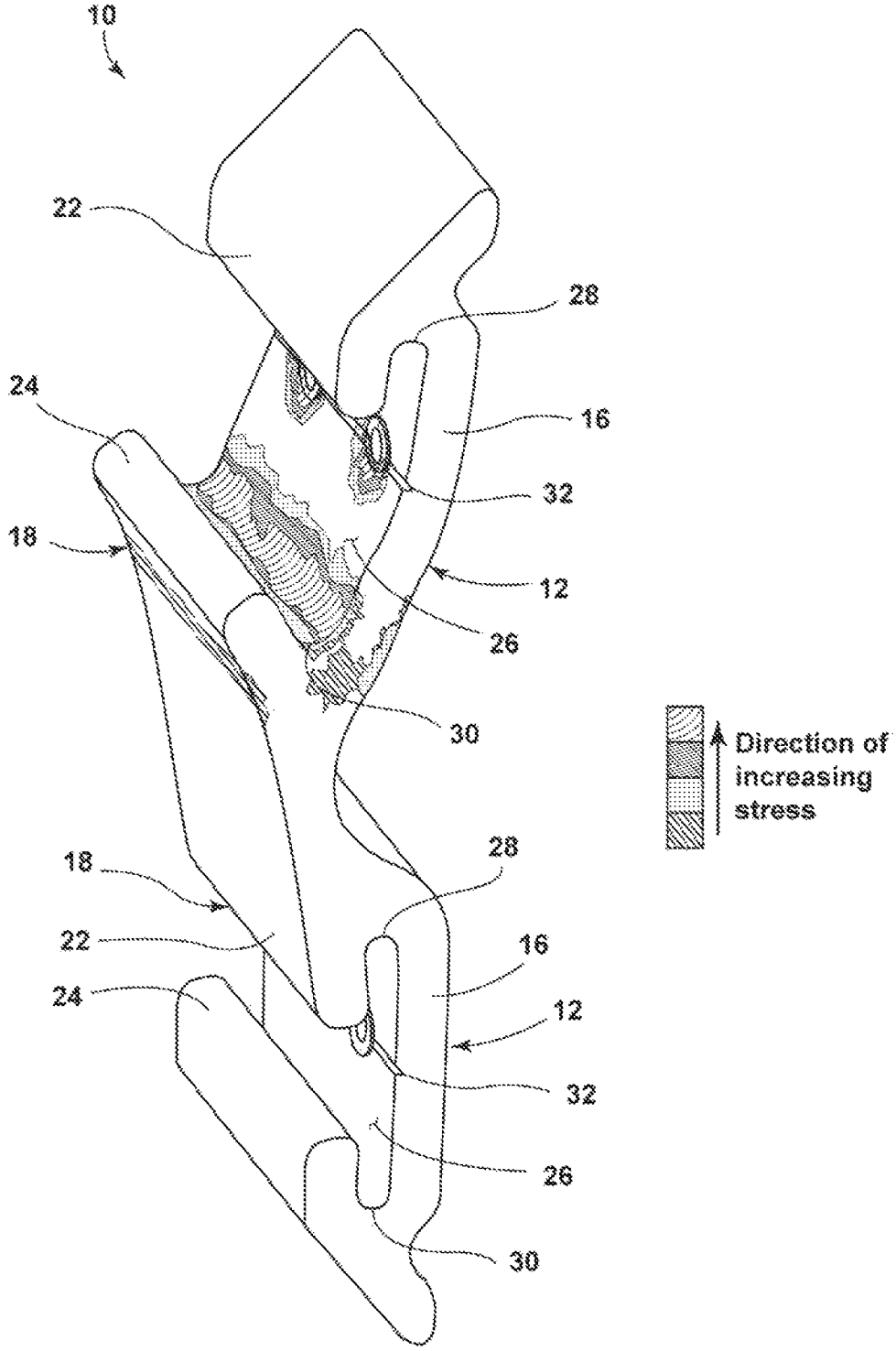
FIG. 4 is a perspective view of a portion of the panel of FIG. 1A illustrating Finite Element Analysis of stress applied to the track from the load applied in FIG. 3A.

In a condition where the slotted wall system 40 is mounted to the wall 38, the bracket 42 is mounted to the track 12, and a load L is carried by the support 44 on the bracket 42, as shown in FIG. 3A, the load applies a force to the track 12. Referring now to FIG. 4, Finite Element Analysis (FEA) shows that, under these conditions, a majority of the load supported by the track 12 is concentrated at certain load-bearing locations. For the particular configuration of the exemplary track 12 subjected to a force applied by a load on the bracket 42, the load-bearing locations include a region A at the lower channel 30 and a region B on the rear wall 16 near the groove 32 corresponding to the location of the hardware for mounting the panel 10 to the wall 38. For the region A, the upper projection 48 of the bracket 42 pulls the lower front wall 24 outward and downward such that the lower channel 30 experiences a significant stress that increases with increasing load. The region B naturally experiences stress because the weight of the panel 10, the brackets 42, and the load is supported by the hardware when the panel 10 is mounted to the wall 38. Other track configurations may exhibit different load-bearing locations depending on the manner in which the brackets couple with the track and the method of mounting the tracks to the wall.

Figures 5A, 5B, 5C, 5D, 5E:
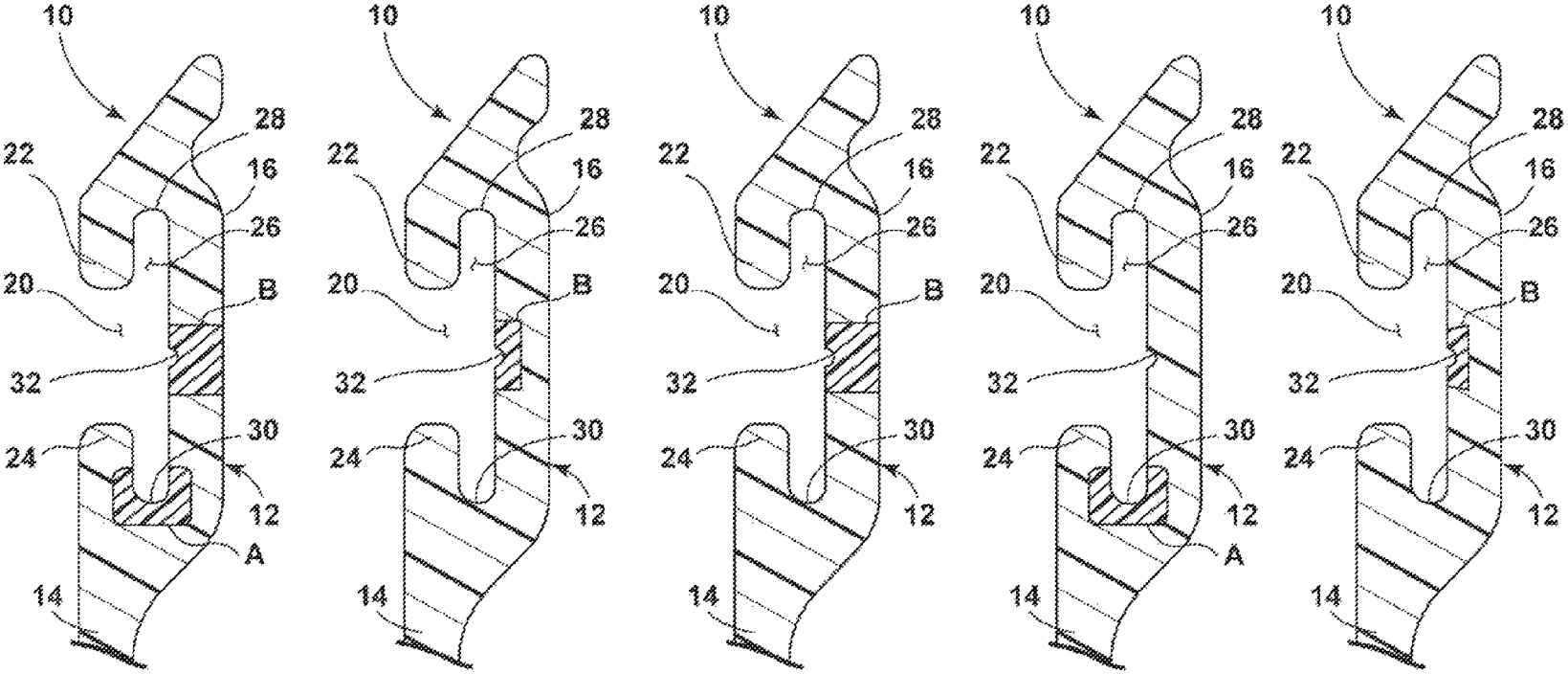
FIG. 5A is a sectional view of the track from the panel of FIG. 1A formed by a coextrusion of a base material and a reinforcing material.
FIGS. 5B-5E are sectional views of the track similar to FIG. 5A illustrating alternative configurations for the reinforcing material.

The track 12 may be made such that it is stronger at the B regions, where higher stresses are encountered, and weaker at the A regions, where lower stresses are encountered. To form the track with the desired relatively stronger and weaker regions, the track 12 may be formed with a relatively weaker base material strengthened with a reinforcing material selectively located at one or more of the load-bearing locations. As shown in FIG. 5A, which is a sectional view of the track 12, the exemplary track 12 may include the reinforcement material at the region A and the region B. The reinforced area at the region A may extend, as illustrated, from the lower front wall 24 and around the lower channel 30 to the rear wall 16, for example, and may have any desired thickness. Alternatively, the reinforced area at the region A may be located only at the portion of the lower channel 30 between the lower front wall 24 and the rear wall 16. Any suitable configuration of the reinforcing material at the load-bearing location is within the scope of the invention. The reinforced area at the region B may be positioned at the groove 32 and may extend upward and downward any suitable distance to provide a desired reinforcement. Further, the reinforced area may extend completely through the rear wall 16, as illustrated, or only partially through the rear wall 16 to any suitable thickness. Furthermore, the reinforcing material may be positioned at as little as one of the load-bearing locations or as many as all of the load-bearing locations. For example, FIGS. 5B and 5C provide examples of employing the reinforcing material at only the region B, wherein the reinforcing material extends only partially through the rear wall 16 in FIG. 5B and completely through the rear wall 16 in FIG. 5C. Meanwhile, FIG. 5D illustrates an exemplary embodiment having the reinforcing material only at the region A. Any combination of areas of the track 12 having the reinforcing material is within the scope of the invention. The reinforcing material may be located at any load-bearing location, which may vary based on the configuration of the track 12 and the manner in which the track 12 is mounted to the wall 38.

The track 12 may be manufactured by coextruding the track 12 with the base material and the reinforcing material. In general, coextrusion is the extrusion of multiple layers of material simultaneously and utilizes two or more extruders to melt and deliver different plastics to a single extrusion head that extrudes the materials in the desired form. For coextrusion of multiple polymeric materials, the materials should be compatible with one another for successful bonding. While any suitable materials and combinations of materials may be employed with the reinforced track 12, exemplary combinations of materials, along with relevant material properties of tensile yield strength and heat deflection temperature, which is a temperature or temperature range at which a polymeric material deforms under a specified load, are provided in the following table.

| Materials | Average Tensile Strength, Yield (psi) | Average Heat Deflection Temperature (° F.), @ 264 psi |
|---|---|---|
| Combination 1 | | |
| BASE: Polyvinyl Chloride (PVC) | 4100 | 150 |
| REINFORCING: Chlorinated Polyvinyl Chloride (CPVC) | 7800 | 210 |
| Combination 2 | | |
| BASE: Polypropylene (PP) | 4700 | 140 |
| REINFORCING: Polypropylene + 30% Glass Filler (PP + 30GF) | 11,300 | 290 |

In Combination 1, the reinforcing material chlorinated polyvinyl chloride (CPVC) exhibits higher yield strength when compared to the base material polyvinyl chloride (PVC), and the CPVC has a significantly higher heat deflection temperature, which improves the load rating of the track 12 in certain environments, such as in a garage with doors and windows closed in hot weather. Mounting hardware, such as screws, can pull out from the track 12 under excessive loading or under an environment where the temperature exceeds about 140° F. The reinforcing material polypropylene+30% glass fiber (PP+30 GF) in Combination 2 exhibits significantly higher yield strength compared to the base material polypropylene (PP) and also has an increased heat deflection temperature. Combinations 1 and 2, therefore, may be suited for applications where only one or both of the regions A and B are reinforced.

In an alternative embodiment, the track 12 may be manufactured by a process whereby one part, such as a reinforcing part, is formed, followed by introducing the solid formed part into the extrusion machine for coextruding the parts together such that a mechanical bond holds the parts together. An example of the track 12 manufactured with such a process is provided in FIG. 5E, which includes the reinforcing material at the region B. Using this method, a larger range of reinforcing materials may be employed with a polymeric track, such as a PVC track, because material compatibility is no longer a materials selection limitation. For this construction, exemplary base materials include, but are not limited to, PVC and PP, and exemplary reinforcing materials include, but are not limited to, polyamide (PA), polycarbonate (PC), acrylonitrile butadiene styrene (ABS), polyoxymethylene (POM), and metal. Tensile yield strength and heat deflection temperatures for these materials are provided below.

| Reinforcing Materials | Average Tensile Strength, Yield (psi) | Average Heat Deflection Temperature (° F.), @ 264 psi |
|---|---|---|
| Polyamide (PA) | 8700 | 140 |
| Polycarbonate (PC) | 9300 | 270 |
| Acrylonitrile Butadiene Styrene (ABS) | 6000 | 190 |
| Polyoxymethylene (POM) | 10,800 | 250 |
| Metal | 86,000 | N/A |

Figure 6:
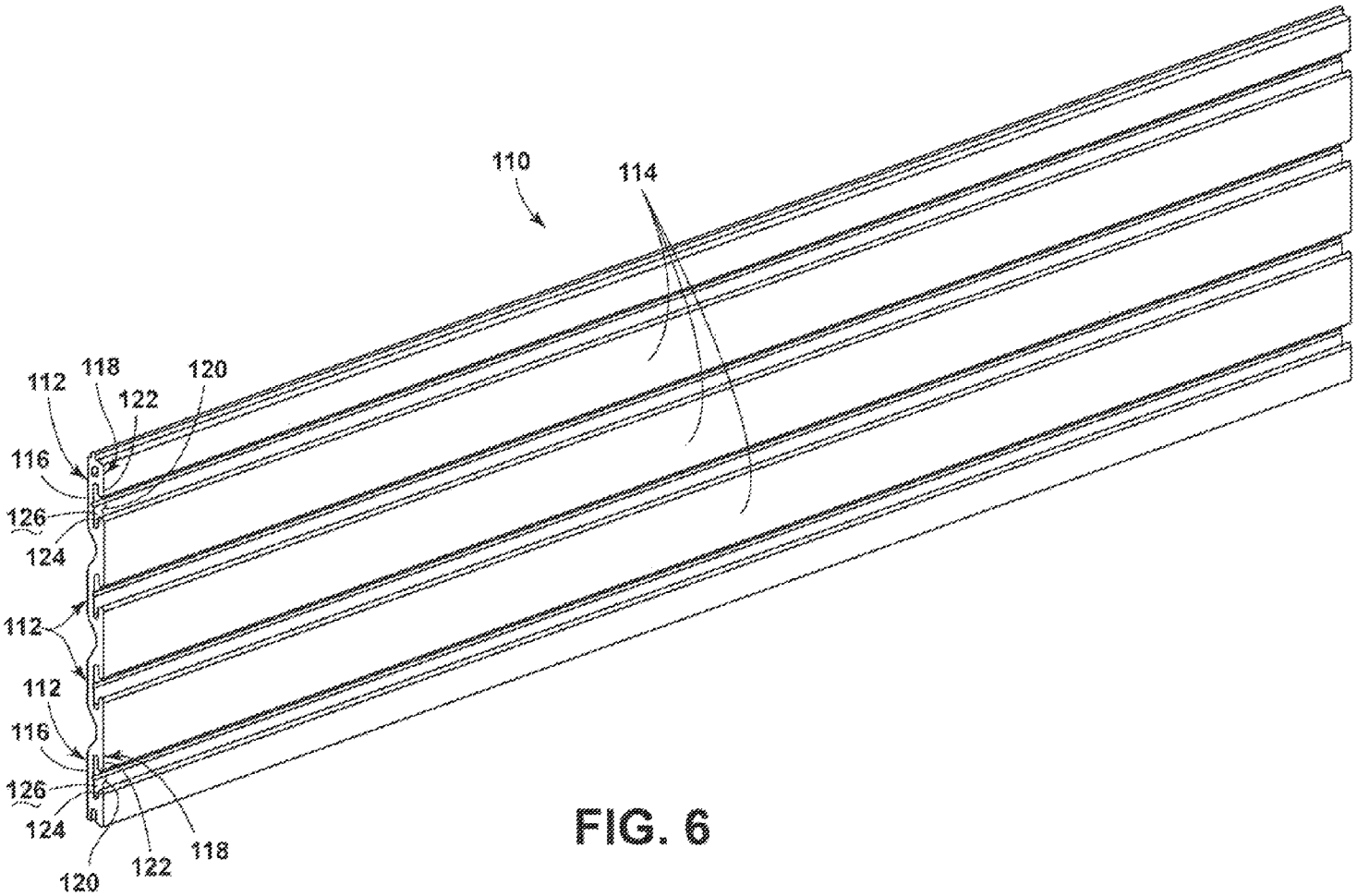
FIG. 6 is a sectional view of an alternative configuration for the panel according to another embodiment of the invention.

As mentioned above, the particular configurations of the track 12 and the bracket 42 are not germane to the invention. The reinforcing material may be used with any design of track and bracket so long as the reinforcing material is selectively positioned at one or more of the load-bearing locations on the track resulting from a load applied to the bracket when the track is mounted to a wall. Further, the track 12 can be incorporated into any style of the panel 10, including the elongated panel of FIG. 1A having two of the tracks 12 and an exemplary panel 110 in FIG. 6 having a larger surface area and four tracks 112. In the embodiment of FIG. 6, elements similar to those of previous embodiments are identified with the same reference numeral bearing a leading "1". Multiples of the panel 110 in FIG. 6 may be used to cover a wall or portion of a wall with the slotted wall system.

While the invention has been specifically described in connection with certain specific embodiments thereof, it is to be understood that this is by way of illustration and not of limitation, and the scope of the appended claims should be construed as broadly as the prior art will permit.

PARTS LIST

10 panel
12 track
14 slat
16 rear wall
18 front wall
20 opening
22 upper front wall
24 lower front wall
26 slot
28 upper channel
30 lower channel
32 groove
38 wall
40 slotted wall system
42 bracket
44 support
46 bracket body
48 upper projection
50 lower projection
52 first portion
54 second portion
56 tab
110 panel
112 track
114 slat
116 rear wall
118 front wall
120 opening
122 upper front wall
124 lower front wall
126 slot

What is claimed is:

1. A slotted wall system comprising:

a wall-mountable track having a slot defining an inner surface having a length; and a load-carrying bracket having a projection received within the slot and bearing against the inner surface in a set of localized regions, which define one or more load-bearing locations on one or more portions of the length of the inner surface; and wherein the track comprises a coextrusion of a base material and a reinforcing material, having a greater yield strength than the base material, with the coextrusion defining the inner surface, and the reinforcing material positioned at localized regions on the inner surface corresponding to at least one of the one or more load-bearing locations.

2. The slotted wall system of claim 1, wherein the track comprises a lower channel defining a portion of the slot, and the load-bearing location is at the lower channel.

3. The slotted wall system of claim 1 wherein the track comprises a rear wall that receives hardware for mounting the track to the wall, and the load-bearing location is at the portion of the rear wall that receives the hardware.

4. The slotted wall system of claim 1 wherein the reinforcing material extends through the entire cross-sectional thickness of the track.

5. The slotted wall system of claim 1, wherein the reinforcing material extends only partially through the cross-sectional thickness of the track.

6. The slotted wall system of claim 1, wherein the reinforcing material deforms at a higher temperature compared to the base material.

7. The slotted wall system of claim 1 wherein the base material and the reinforcing material are selected from at least one of the following combinations: polyvinyl chloride and chlorinated polyvinyl chloride, respectively, and polypropylene and polypropylene with glass fiber, respectively.

8. The slotted wall system of claim 1 wherein the reinforcing material is selected from the group consisting of polyamide, polycarbonate, acrylonitrile butadiene styrene, polyoxymethylene, and metal.

9. A panel for a slotted wall system including one or more brackets configured to mount a load to the panel, the panel comprising:

a track forming a slot defining an inner surface having a length and configured to receive a portion of a bracket;

wherein the panel is formed of a base material coextruded with a reinforcing material, which has a greater yield strength than the base material, and the reinforcing material is located in at least one portion of a length of the panel to define a set of reinforced localized regions of the inner surface.

10. The panel of claim 9 wherein the track comprises a lower channel defining a portion of the slot, and the localized regions are is at the lower channel.

11. The panel of claim 9 wherein the track comprises a rear wall that receives hardware for mounting the track to the wall, and the localized regions are is at the portion of the rear wall that receives the hardware.

12. The panel of claim 9 wherein the reinforcing material extends through the entire cross-sectional thickness of the track.

13. The panel of claim 9 wherein the reinforcing material deforms at a higher temperature compared to the base material.

14. The panel of claim 9 wherein the base material and the reinforcing material are selected from at least one of the following combinations: polyvinyl chloride and chlorinated polyvinyl chloride, respectively, and polypropylene and polypropylene with glass fiber, respectively.

* * * * *